US006655335B2

(12) United States Patent
Imafuku et al.

(10) Patent No.: US 6,655,335 B2
(45) Date of Patent: Dec. 2, 2003

(54) SMALL ENGINE FOR POWER TOOLS

(75) Inventors: Kenji Imafuku, Hiroshima (JP); Hisau Kodama, Hiroshima (JP); Hidenori Hiraki, Hiroshima (JP)

(73) Assignee: Shindaiwa Kogyo Co., LTD (JP)

( * ) Notice: Subject to any disclaimer, the term of this patent is extended or adjusted under 35 U.S.C. 154(b) by 0 days.

(21) Appl. No.: 10/188,507

(22) Filed: Jul. 3, 2002

(65) Prior Publication Data

US 2003/0037749 A1 Feb. 27, 2003

(51) Int. Cl.[7] ..... F02N 17/00

(52) U.S. Cl. ..... 123/179.18; 55/385.7; 55/417

(58) Field of Search ..... 123/179.18, 179.16, 123/330, 376; 55/417, DIG. 28, 385.7

(56) References Cited

U.S. PATENT DOCUMENTS

| | | | | |
|---|---|---|---|---|
| 1,396,418 | A | | 11/1921 | Gilliard |
| 2,391,380 | A | | 12/1945 | Barker |
| 2,946,324 | A | | 7/1960 | Casini |
| 3,613,646 | A | | 10/1971 | Hisada |
| 3,672,172 | A | | 6/1972 | Hammond |
| 3,859,968 | A | | 1/1975 | Stinebaugh |
| 3,973,532 | A | | 8/1976 | Litz |
| 4,169,434 | A | | 10/1979 | Guenther |
| 4,194,470 | A | | 3/1980 | Magner |
| 4,471,728 | A | | 9/1984 | Borst et al. |
| 4,473,340 | A | | 9/1984 | Walsworth |
| 4,488,519 | A | | 12/1984 | Kishida |
| 4,538,567 | A | | 9/1985 | Grow |
| 4,538,569 | A | | 9/1985 | Sugino et al. |
| 4,558,671 | A | | 12/1985 | Stinebaugh |
| 4,617,879 | A | | 10/1986 | Mori |
| 4,632,085 | A | | 12/1986 | Misawa et al. |
| 4,682,570 | A | | 7/1987 | Velencei |
| 4,708,107 | A | | 11/1987 | Stinebaugh |
| 4,834,784 | A | * | 5/1989 | Bidanset ..... 55/385.7 |
| 4,864,979 | A | | 9/1989 | Eickmann |
| 4,955,943 | A | | 9/1990 | Hensel et al. |

(List continued on next page.)

FOREIGN PATENT DOCUMENTS

| | | |
|---|---|---|
| CA | 1255607 | 4/1984 |
| CH | 248605 | 2/1948 |
| DE | 2411513 | 3/1974 |
| DE | 3314721 A1 | 10/1984 |
| EP | 94106092.3 | 10/2001 |

(List continued on next page.)

OTHER PUBLICATIONS

Chinn, Peter, "Engine Review", article, May 1981, pp 32–34; 90–91.

(List continued on next page.)

*Primary Examiner*—Carl S. Miller
*Assistant Examiner*—Arnold Castro
(74) *Attorney, Agent, or Firm*—Robert L. Harrington; Schwabe, Williamson & Wyatt

(57) ABSTRACT

A small engine for outdoor power equipment wherein fuel is pumped to the engine's combustion chamber by a reciprocating piston. A desired rate of reciprocation is determined with the engine under load, e.g., with a grass trimmer cutting grass. Avoidance of undesired engine racing is accomplished by restricting airflow to the carburetor which prevents significant increased reciprocation over that desired when cutting. A choke mechanism is provided with a pair of end portions, one of which closes air to the carburetor for starting and the other provides a spaced barrier for inhibiting blow-back. The one end portion includes an inset that seats in the opening through which air enters the carburetor for providing rigidity and to insure closing.

6 Claims, 2 Drawing Sheets

U.S. PATENT DOCUMENTS

| | | | | | |
|---|---|---|---|---|---|
| 5,005,537 | A | | 4/1991 | Maissant | |
| 5,072,699 | A | | 12/1991 | Pien | |
| 5,279,269 | A | | 1/1994 | Aizawa et al. | |
| 5,343,839 | A | | 9/1994 | Baika et al. | |
| 5,347,967 | A | | 9/1994 | Todero et al. | |
| 5,419,289 | A | | 5/1995 | Duret et al. | |
| 5,579,735 | A | | 12/1996 | Todero et al. | |
| 5,586,523 | A | | 12/1996 | Kawahara et al. | |
| 5,628,295 | A | | 5/1997 | Todero et al. | |
| 5,657,724 | A | | 8/1997 | Brown et al. | |
| 5,678,525 | A | | 10/1997 | Taue | |
| 6,116,581 | A | * | 9/2000 | Watanabe et al. ..... | 123/179.18 |

FOREIGN PATENT DOCUMENTS

| | | |
|---|---|---|
| FR | 2519695 | 9/1986 |
| GB | 2 30475 | 1/2001 |
| IT | 474143 | 2/1951 |
| JP | 47-35516 | 11/1972 |
| JP | 51-149408 | 12/1976 |
| JP | 58-85320 | 5/1983 |
| JP | 59-77036 | 5/1984 |
| JP | 59-229017 | 12/1984 |
| JP | 61-200330 | 2/1985 |
| JP | 61-49130 | 3/1986 |
| JP | 62-17320 | 1/1987 |
| JP | 62-35027 | 2/1987 |

OTHER PUBLICATIONS

"New Environmental Technology Developed for Portable Lawn & Garden Engines", article, Ryobi News, Nov. 17, 1992, pp 1–19, Ryobi America Corporation.

Okanishi, Naoki, Itaru Fukutani, Eiichi Watanbe, "Torque Boosting of 4–Stroke Cycle Spark–Ignition Engine in Low and Middle Engine Speed Ranges by Crankcase–Supercharging" article, Feb. 27, 1984, SAE Technical Paper Series 840423.

Okanishi, Naoki, Itaru Fukutani, "Application of Crankcase– Supercharging to a 4–Stroke Cycle Compression Ignition Engine", article, Feb. 28, 1994, SAE Technical Paper Series 940840.

Okanishi, Naoki, Itaru Fukutani, "On–Road Tests Using Small Crankcase–Supercharged 4–Stroke Cycle Engines", article, Feb. 28, 1994, SAE Technical Paper Series 940841.

* cited by examiner

SMALL ENGINE FOR POWER TOOLS

Priority is claimed under 35 USC §119(a) based on Japanese Patent Application Serial No. 206573 filed Jul. 6, 2001.

FIELD OF INVENTION

The present invention relates to a small engine for hand operated power tools wherein the air inlet to the carburetor is restricted to limit overrunning of the engine and further including a choke mechanism that enhances closure of the air inlet for starting and inhibits blow-back from the carburetor.

BACKGROUND OF THE INVENTION

This invention relates to small engines such as used to power outdoor power tools including grass trimmers, hedge trimmers, brush cutters and the like. Such engines have carburetors that receive fuel and air and mix the fuel and air in a desired relationship which is thereafter conveyed to the combustion chamber of the engine in the form of vapor. The air is initially directed from an air cleaner to an air intake port of the carburetor. The passageway from the air cleaner to the air intake port in prior engines is at least the same size as the intake port of the carburetor.

A problem that is experienced during the use of such engines is the tendency by the operator to overrun or race the engine. Such overrunning is detrimental to the wear life of the engine and can also create safety concerns. Overrunning occurs when the throttle is held open in an unloaded condition. For example, in the use of any of the mentioned power tools, the tool may be used in a sweeping motion with a cutting or loaded condition occurring in one direction, and a non-cutting or non-loaded condition occurring in the other direction. A wide open throttle may be desired for the cutting or loaded condition and not in a non-cutting or non-loaded condition. In the loaded condition the speed is automatically slowed due to load resistance and a desired speed is maintained. The speed substantially increases when there is no load resistance being applied.

Whereas the operator has control over the throttle, it is common that at least part of the time the engine is racing faster than desirable or necessary.

One solution to this problem is the addition of an electrically controlling magneto-generator, which is the power supply for the engine's spark plugs. The magneto-generator controls the ignition timing to establish a maximum rotation speed. Whereas this is a solution to the problem, it adds substantial costs to the engine.

A further problem that is addressed relates to the operability of the choke mechanism. The choke mechanism is used to selectively close the air inlet to the carburetor. Typically the choke mechanism comprises a plate that is slid (as by pivoting) into place over the air inlet. The result is a higher ratio of fuel to air mixture which aids in starting the engine. This choke mechanism can, over time, become loose, e.g., due to flexure, so that the desired closing of the air inlet is not achieved and starting is made more difficult. A still further problem is referred to as blowback. It can happen that in the process of pumping the fuel mixture from the carburetor to the crankcase chamber, a reverse pressure is created to blow the mixture back through the air cleaner and toward the operator. This is undesirable.

BRIEF SUMMARY OF THE INVENTION

The three mentioned problems are resolved for the preferred embodiment at a location between the air cleaner and the air inlet to the carburetor. The mouth or opening that is the air inlet has a given dimension that becomes more restricted dimensionally as air travels through the carburetor. Such dimensional configuration is desirable if not necessary to achieve the required air fuel mix and vaporization. In prior engines, the large mouth or inlet opening permits a substantial volume of air to flow into and through the carburetor. As the engine runs faster, the piston correspondingly pumps a greater volume of fuel to the combustion chamber. The throttle needs to be at a given setting to produce a desired cutting action and does so without undue damage to the engine. That same setting when non-loaded will cause rapid or over running of the engine which is harmful to the engine and can create a safety concern.

The above problem is resolved by creating an airflow restriction at the mouth of the carburetor in the form of a plate that covers the mouth or inlet. An opening in the plate is sized to limit airflow into the carburetor. The suction or pumping that is created by the piston, at the point where it exceeds the limit imposed by the restriction, affects the balance of fuel to air mixture and such inhibits racing of the engine. The opening is sized to accommodate the anticipated work load for a particular engine. For example, it may be determined that a desirable cutting speed (under load) is X RPMs of the crankshaft and the opening is provided to accommodate piston reciprocation that produces that speed of the crankshaft. Above X RPMs the fuel to air mixture is increased, resulting in the slowing of the engine, i.e., the RPMs are substantially retained at that which produces the desirable cutting speed.

The choke plate flexure is alleviated by providing the choke plate, i.e., an end portion of the choke mechanism with an inset directed toward the carburetor and which functions as a stiffener. The inset is configured to fit, e.g., loosely, into the sized opening described above. As the end portion is pivoted and the inset portion is thereby aligned with the opening, the choke plate inset snaps into the opening and thus causing the plate to fully close off the opening. The choke plate inset has a small opening to allow a minimal air flow into the carburetor as desired for combustion of the fuel during the start-up mode. The snap-in action can be heard by the operator as a clicking sound to enable the operator to know that the choke plate is seated in the opening.

The blow-back of the fuel-air mixture is inhibited by a second arm or end portion (blow-back plate) that is provided on the choke mechanism. As the choke mechanism is pivoted to its non-choking position, the second end portion is aligned with but spaced from the opening. The air is thus allowed to flow around the plate and into the carburetor. However, in a blow-back situation, the direct path back through the carburetor and toward the air cleaner is impeded by the blow-back plate.

DESCRIPTION OF THE DRAWINGS

FIG. 3(*b*) is cross-sectional view as taken on view lines 3*b*—3*b* of FIG. 3(*a*).

DETAILED DESCRIPTION OF THE PREFERRED EMBODIMENT

Figure 1:
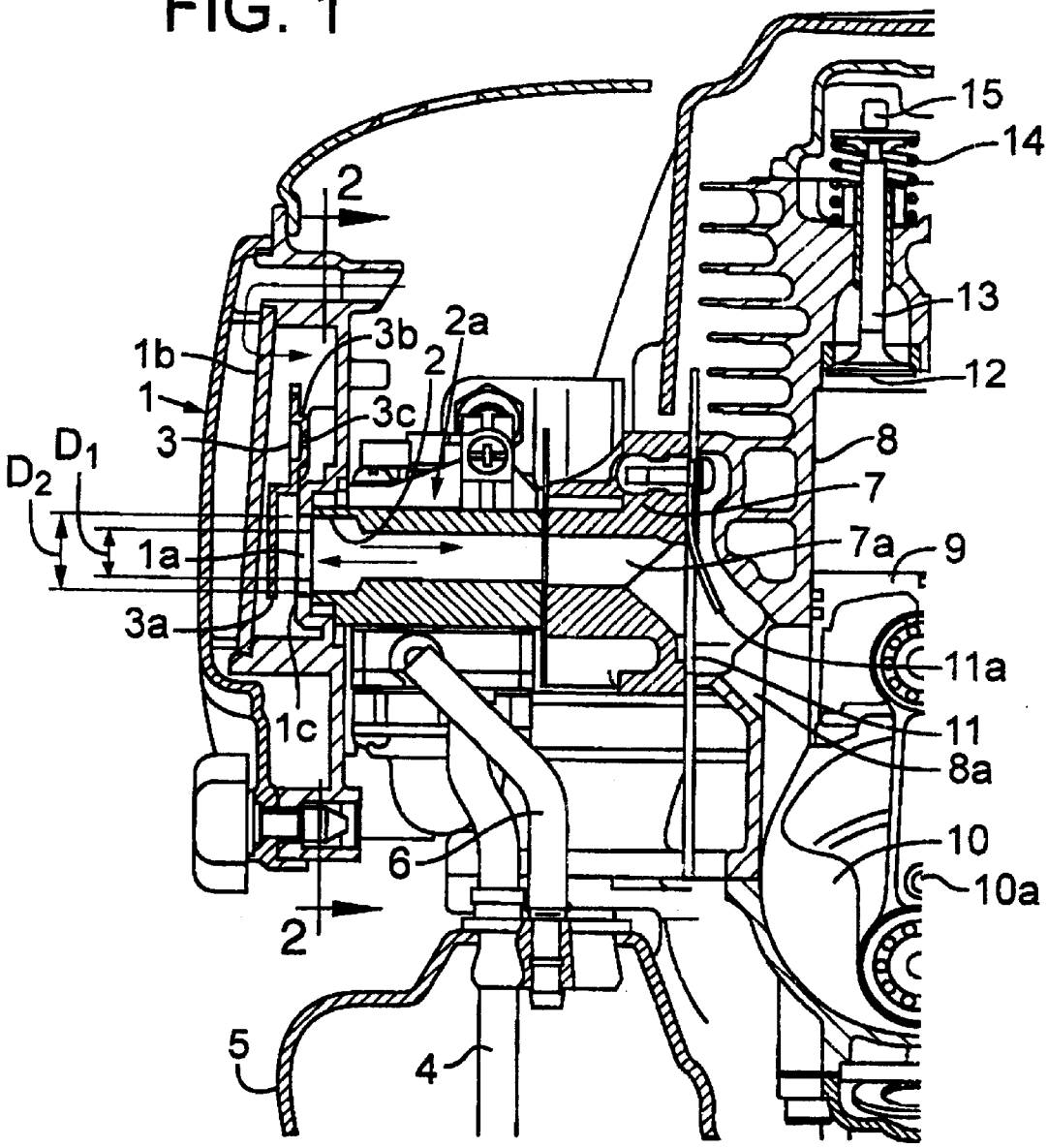
FIG. 1 is a cross-section view of an engine portion including an air cleaner, a carburetor and passages for conveyance of fuel from the carburetor in and through the engine block.

Reference is made to FIG. 1 which illustrates pertinent components of a small engine used for outdoor power tools.

The engine as illustrated is a four-cycle engine which is fueled by a mixture of fuel (gasoline), lubricant (oil) and air; and which incorporates valve operating mechanism that is placed in the flow path of the mixture for lubrication of the mechanism. An example of such an engine is illustrated in U.S. Pat. No. 4,708,107 ('107).

Reference arrow 1 in general indicates the air cleaner of the engine including an air filter 1*b*. Reference arrow 2 generally indicates the carburetor including an air intake port 2*a* leading to passageway 7*a*. A wall member 1*c* of air cleaner 1 is configured to fit over the intake port 2*a* of carburetor 2 as illustrated, and an opening of reduced diameter $D_1$ is formed through the wall member 1*c* to restrict the flow of air through the air cleaner and into the carburetor.

As will be noted, the intake port 2*a* of the carburetor has a size $D_2$ that is larger than the diameter $D_1$ of the opening through wall portion 1*c*. The diameter $D_2$ is sized to accommodate the desired operation of the carburetor as well known to the art. Thus fuel (gas and oil mixture) is directed through fuel line 4 and due to the venturi effect of the carburetor, produces the desired vaporized fuel for operation of the engine. The fuel-air mixture is drawn through passage 8*a* into the crank chamber 10 as a result of reciprocation of the piston 9 which functions like a pump. The mixture is directed through a further passageway (not shown, but see the '107 patent referred to above) to the combustion chamber located above the piston 9 and within cylinder 8. The fuel is sequentially ignited in the combustion chamber as the piston 9 reciprocates up and down, the reciprocation being the result of timed sequential ignitions (not illustrated but known to the art). The reciprocating piston produces rotation of the crankshaft 10*a* (illustrated in part within the crank chamber) and the exhaust from the ignited fuel is forced out through exhaust valve 13. Again, the mechanism for accomplishing the valve actuation and timing thereof is known to the art and is more fully explained in prior patents, e.g., the '107 patent. The components which are illustrated and not discussed herein are fuel supply pipe 4, fuel tank 5, return pipe 6, insulating member 7, check valve 11, presser plate 11*a*, exhaust valve 12, valve rod 13, valve spring 14 and rocker arm 15.

Important to the present invention is the appreciation that as fuel from fuel line 4 is increased via throttle actuation, the piston 9 is reciprocated faster which in turn produces increased pumping of the fuel-air mixture from the carburetor to the combustion chamber. As the crankshaft 10*a* is placed under load, e.g., when cutting, the reciprocation of the piston 9 is resisted and the rate of reciprocation is restrained. Increased power is generated to maintain the desired piston reciprocation and crankshaft rotation for achieving the desired cutting speed.

When the load is removed, e.g., when placed in a non-cutting mode, the reciprocation will be induced to rapidly increase and such is undesired from the point of wear-life and also safety. Such is resisted by the opening $D_1$ through wall 1*c* which is provided dimensionally to generate a desired fuel mixture to support piston reciprocation when the crankcase shaft is under load. However, as the engine tries to race faster, as when unloaded or lightly loaded, the induced combustion activity is in part starved of the necessary airflow into the carburetor and thus the engine is prevented from excessive racing.

Figure 2:
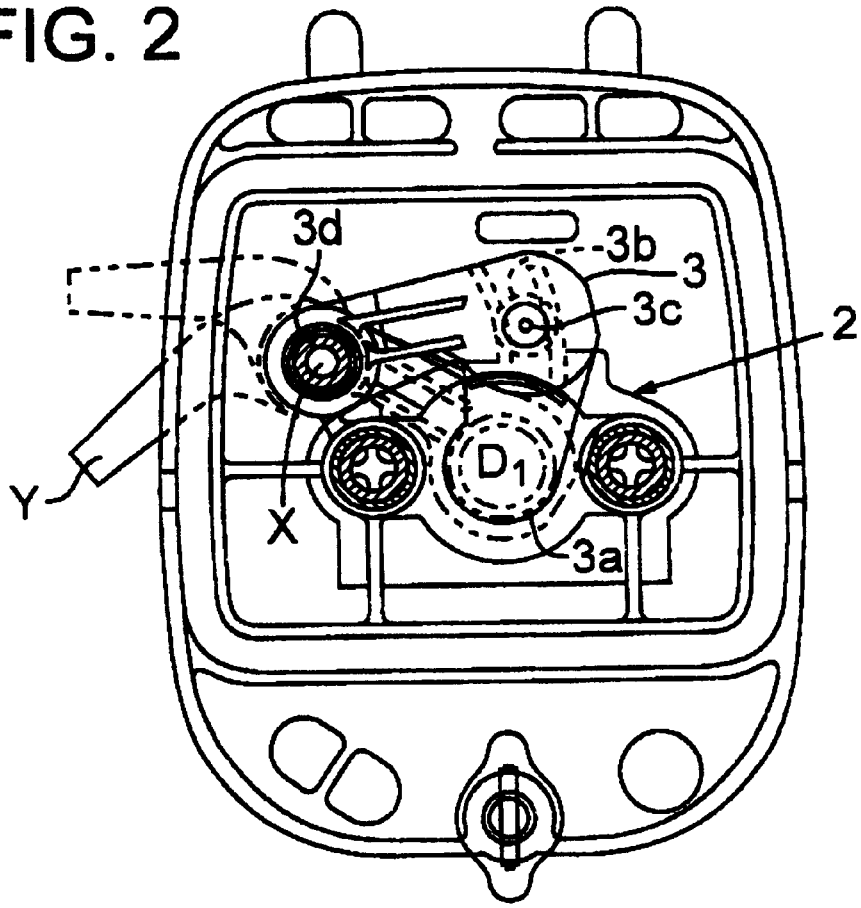
FIG. 2 is a section view taken on view lines 2—2 of FIG. 1 showing the choke mechanism positioned over the inlet to the carburetor.
Figure 3A:
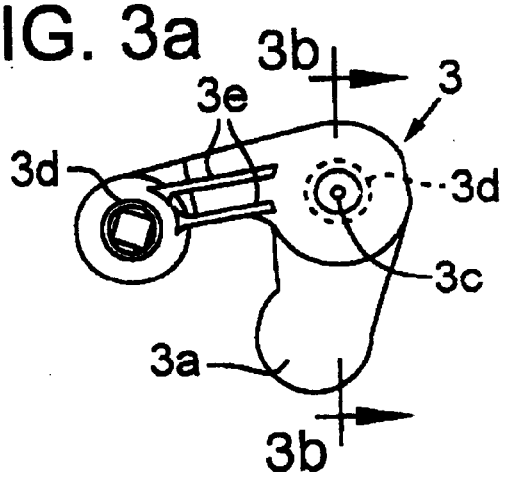
FIG. 3(*a*) is a frontal view of the choke mechanism.
Figure 3B:
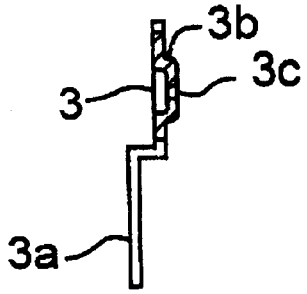

Reference is now made to the choke mechanism 3 shown in frontal and cross section views in FIGS. 3(*a*), 3(*b*). With reference also to FIG. 2, it will be noted that the end 3*d* is pivoted at a position X remote from the opening of $D_1$ and end plates 3*b* and 3*a* are cooperatively positioned to be pivotally positioned with either end plate 3*b* or end plate 3*a* in alignment with opening $D_1$. From FIG. 1, it will be seen that end plate 3*b* is configured to pivotally slide in contact relation with wall portion 1*c*. A center portion of the end plate 3*b* is inset as seen in FIGS. 1 and 3(*b*) and when engaging wall portion 1*c* biases the end plate 3*b* slightly outward which is readily achieved by manipulation of lever Y (see FIG. 2).

The inset of end plate 3*b* is sized to fit the opening $D_1$, and upon alignment, the inset seats inside the opening $D_1$. A small hole 3*c* in the inset permits minimal air to pass into the carburetor as desired for starting of the engine. Upon starting, the choke is opened to the position of FIG. 2 accomplished by shifting of lever Y from the dash-line position to the solid-line position. With the choke mechanism in this latter (normal operation) position, end plate 3*a* is positioned in alignment with, but spaced from, opening $D_1$ as illustrated in FIG. 1. In this position, air freely circulates around the end plate 3*a* and into and through opening 1*a* and passageway 7*a*. However, should blow-back occur, end plate 3*a* becomes a barrier to prevent such blow-back from extending into and through the air cleaner.

Whereas the disclosure is intended as a preferred embodiment of the invention, those skilled in the art will conceive of numerous variations and modifications without departing from the scope of the invention. The claims are intended to be interpreted in accordance with the normal meaning applied to the terms thereof and specifically not as means plus function terms under 35 USC §112, paragraph 6, unless specifically identified as "means for" in accordance with Patent Office guidelines.

The invention claimed is:

1. A small engine comprising:

a carburetor, an air cleaner through which air is supplied and a source of fuel from which fuel is supplied, both being directed into the carburetor whereat vaporized fuel is produced, an air inlet to the carburetor and a passageway that extends through the carburetor and into a crankcase chamber and from the crankcase chamber to a combustion chamber overlying a cylinder and reciprocating piston, said reciprocating piston producing a pumping action for pumping vaporized fuel from the carburetor and through the passageway and into the combustion chamber;

said engine having a desired work output as measured by the rate of reciprocation of the piston while in a working mode; and a restriction member positioned between the air cleaner and the air inlet to the carburetor, said restriction member having an opening through which air enters the air inlet, said opening sized to restrict air flow to substantially the air flow required to achieve said rate of reciprocation of the piston while in the working mode.

2. A small engine as defined in claim 1 wherein the air cleaner comprises a rear wall configured to fit over the air inlet of the carburetor and providing said restriction member, said rear wall having an opening through which air enters the air inlet, said opening substantially smaller than said air inlet.

3. A small engine as defined in claim 2 wherein a choke member is pivotally mounted to said air cleaner and having a pivotal end portion, said pivotal end portion comprising a plate that is pivotal to a first position overlying said opening and abutting said rear wall surrounding said opening, an inset provided on said plate and configured to fit said opening and projected into said opening with the end portion pivoted to said first position.

4. A small engine as defined in claim 3 wherein the choke member has a second end portion, said choke member pivoted into a second position with said second end portion overlying and spaced from the opening to thereby provide a barrier to blow-back from the carburetor inlet.

5. A small engine comprising:

a carburetor, an air cleaner through which air is supplied and a source of fuel from which fuel is supplied, both being directed into the carburetor whereat vaporized fuel is produced, an air inlet to the carburetor and a passageway that extends through the carburetor and into a crankcase chamber and from the crankcase chamber to a combustion chamber overlying a cylinder and reciprocating piston, said reciprocating piston producing a pumping action for pumping vaporized fuel from the carburetor and through the passageway and into the combustion chamber; and an opening from the air cleaner and into the carburetor through which air enters the carburetor, a choke mechanism including a choke plate that is slideable between a first position where the plate is out of the path of air flow through the opening and a second position where the plate is in the path of air flow through the opening, an inset provided in said plate, sized to fit said opening and located to project into said opening with the choke plate in said second position, and a reduced opening in the inset to provide minimal air flow into the carburetor for starting of the engine.

6. A small engine comprising:

a carburetor, an air cleaner through which air is supplied and a source of fuel from which fuel is supplied, both being directed into the carburetor whereat vaporized fuel is produced, an air inlet to the carburetor and a passageway that extends through the carburetor and into a crankcase chamber and from the crankcase chamber to a combustion chamber overlying a cylinder and reciprocating piston, said reciprocating piston producing a pumping action for pumping vaporized fuel from the carburetor and through the passageway and into the combustion chamber;

an opening from the air cleaner and into the carburetor through which air enters the carburetor, a choke mechanism including a choke plate that is slideable between a first position where the plate is out of the path of air flow through the opening and a second position where the plate is in the path of air flow through the opening, an inset provided in said plate, sized to fit said opening and located to project into said opening with the choke plate in said second position, and a reduced opening in the inset to provide minimal air flow into the carburetor for starting of the engine; and an opening from the air cleaner and into the carburetor through which air enters the carburetor, a choke mechanism including a choke plate having two end portions, said choke plate slideable between a first position with one end portion positioned in the path of air flow through the opening and a second position with the other end portion positioned in the path of air flow through the opening, said one end portion in said first position closing air flow through the opening, a small opening in said first end portion permitting minimal flow of air into the carburetor to facilitate starting of the engine, and said second end position as positioned in the path of air flow through the opening spaced from said opening to permit flow of air around the second end portion while providing a barrier to blow-back from the carburetor.

* * * * *